US008404280B2

(12) United States Patent
Muthusamy et al.

(10) Patent No.: US 8,404,280 B2
(45) Date of Patent: Mar. 26, 2013

(54) TEMPLATE FREE AND POLYMER FREE METAL, NANOSPONGE AND A PROCESS THEREOF

(75) Inventors: Eswaramoorthy Muthusamy, Bangalore (IN); Sai Krishna Katla, Bangalore (IN)

(73) Assignee: Jawaharlal Nehru Centre for Advanced Scientific Research, Bangalore (IN)

( * ) Notice: Subject to any disclaimer, the term of this patent is extended or adjusted under 35 U.S.C. 154(b) by 0 days.

(21) Appl. No.: 12/935,129

(22) PCT Filed: May 4, 2009

(86) PCT No.: PCT/IN2009/000266

§ 371 (c)(1),
(2), (4) Date: Sep. 28, 2010

(87) PCT Pub. No.: WO2009/138998

PCT Pub. Date: Nov. 19, 2009

(65) Prior Publication Data

US 2011/0014300 A1 Jan. 20, 2011

(30) Foreign Application Priority Data

May 5, 2008 (IN) ..... 1105/CHE/2008

(51) Int. Cl.
*A01N 59/16* (2006.01)
*A01P 1/00* (2006.01)
*B32B 5/18* (2006.01)

(52) U.S. Cl. ..... 424/618; 428/613; 75/330; 977/700

(58) Field of Classification Search ..... None
See application file for complete search history.

(56) References Cited

FOREIGN PATENT DOCUMENTS

WO 2004001278 A2 12/2003
WO 2007095454 A2 8/2007

OTHER PUBLICATIONS

Ramanath et al "Templateless Room-Temperature Assembly of Nanowire Networks from Nano-particles," Langmuir 2004, 20, 5583-5587).*
Ramanath et al "Templateless Room-Temperature Assembly of Nanowire Networks from Nanonparticles," Langmuir 2004, 20, 5583-5587.*
Song et al "Synthesis of Platinum Nanowire Networks Using a Soft Template," Nano Lett., vol. 7, No. 12, 2007.*
Lu et al ("Simple Template-Free Solution Route for the Controlled Synthesis of Cu(OH)2 and CuO Nanostructures," J. Phys. Chem. B 2004, 108, 17825-17831).*
Caswell et al ("Seedless, Surfactantless Wet Chemical Synthesis of Silver Nanowires," Nano Letters 2003 vol. 3, No. 5, 667-669).*

* cited by examiner

*Primary Examiner* — Suzanne Ziska
(74) *Attorney, Agent, or Firm* — Harness, Dickey & Pierce, P.L.C.

(57) ABSTRACT

The present invention provides solution to the problem involved in preparation of metal nanosponges using templates and polymers. The instant invention is successful in providing a simple, template free single step process for the preparation of metal nanosponges having porous low density and high surface area. These metal nanosponges were found to be good self-supported substrates for surface-enhanced Raman spectroscopy (SERS) and have shown significant anti-bacterial activity.

Figure 1:
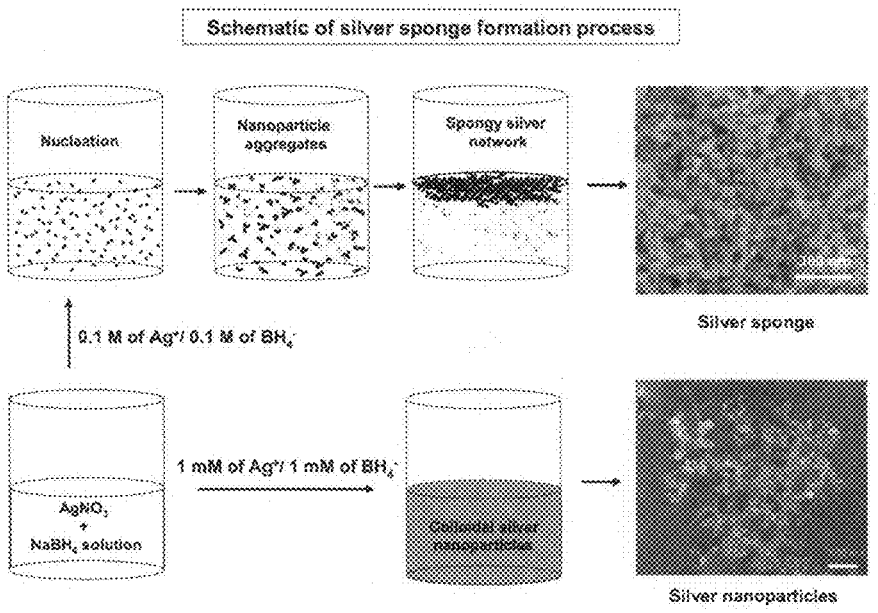

26 Claims, 21 Drawing Sheets
(11 of 21 Drawing Sheet(s) Filed in Color)

Fig: 3 (a), (b), (c)

(a) (b)

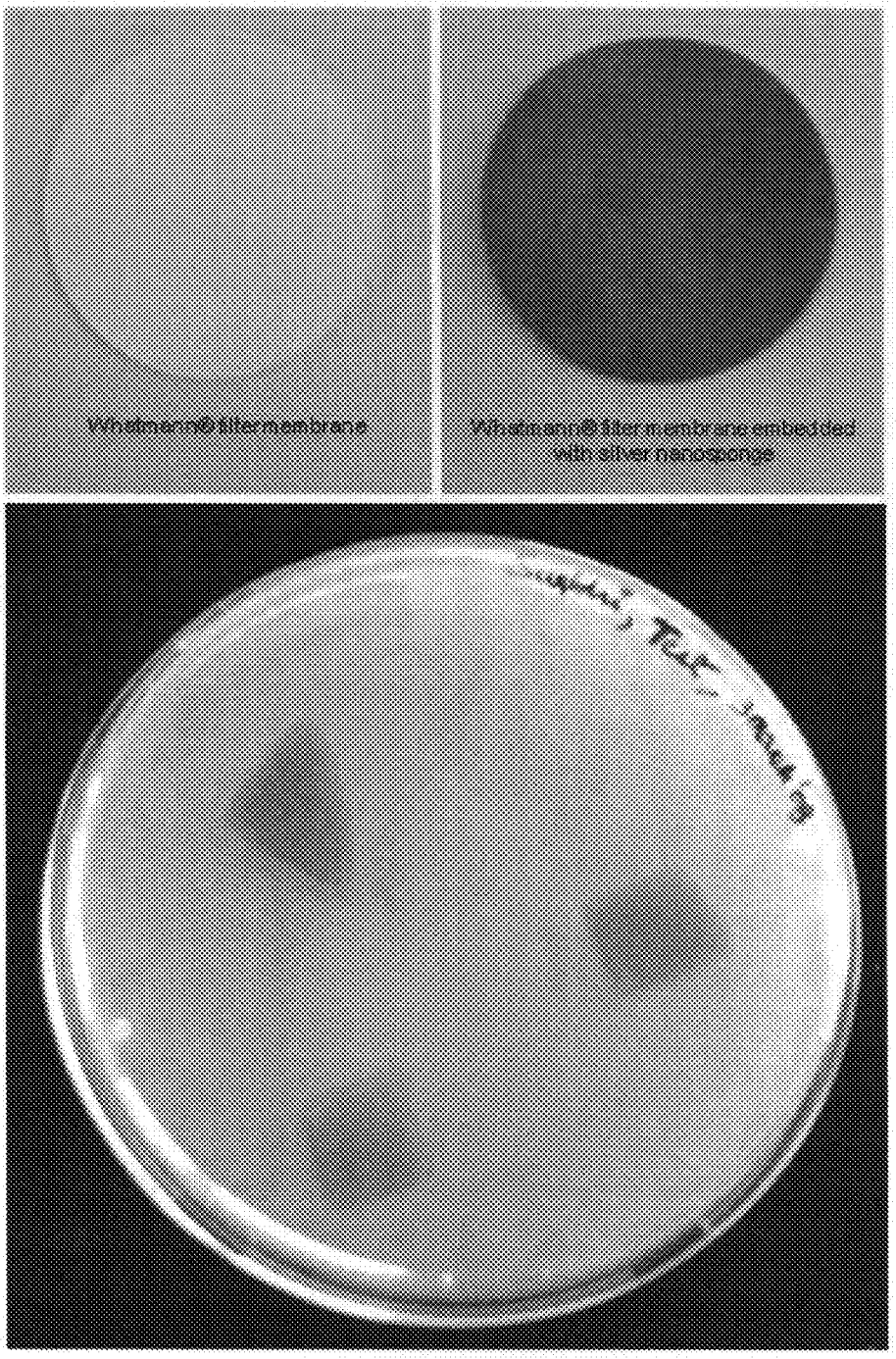
Fig: 31 (a), (b), (c)

TEMPLATE FREE AND POLYMER FREE METAL, NANOSPONGE AND A PROCESS THEREOF

The file of this patent or application file contains at least one drawing executed in color. Copies of this patent or patent application publication with color drawings will be provided by the Patent and Trademark Office upon request and payment of necessary fee.

FIELD OF THE INVENTION

The present invention is in relation to the field of nanotechnology. More particularly, the present invention provides template free metal nanosponge and also a simple process for the preparation of such metal nanosponge.

BACKGROUND AND PRIOR ART OF THE INVENTION

Metal sponges are identified as a new class of materials for their unique properties such as low density, gas permeability and thermal conductivity and have the potential to play a major role in adsorption, catalysis, fuel cells, membranes and sensors. Though significant progress has been made in making and manipulating high surface area metal oxide sponges, the same is not true for their metallic counterparts. The most versatile template based approach, used for the synthesis of porous metal oxides did not give the desired results with the metals and in particular, the noble metals such as Ag, Au, Pt and Pd which are industrially more valuable. For example, in an elegant approach, Mann and co-workers, synthesized metallic foams of silver and gold using the polysaccharide, dextran, as the sacrificial template [1]. However, the macroporous silver foam obtained has the surface area of less than 1 $m^2/g$. More recently, Rao et al [2] have reported the synthesis of macroporous silver foam with the surface area around 1 $m^2/g$ by calcining the silver salt-surfactant, tritonX-100 composite at 550° C. Cellulose fibers [3] and, poly(ethyleneimine) hydrogel [4] have also been used as soft templates to prepare porous silver frameworks. Even, biologically formed porous skeleton was used as a template to obtain macroporous gold framework [5]. In all these cases, the template removal needs high temperature calcinations which sinter the metallic structure and thereby reduces the surface area drastically. The low temperature route, on the other hand uses colloidal crystals templates such as silica or latex spheres [6] which involves multi-step process in addition to the dissolution of templates in organic solvents or HF. Pattern-forming instabilities during selective dissolution of silver from Ag—Au alloys reported to give nanoporous gold with controlled multi-modal pore size distribution [7]. Herein, we report an instantaneous formation of high surface area noble metal sponges through a template free, one-step, inexpensive, method. By optimizing a very well known Oswald ripening process we were able to generate a three dimensional porous structure made up of nanowire networks. Since this process involves a simple, room temperature reduction of metal salts with sodium borohydride, it can be scalable to any amount.

OBJECTIVES OF THE PRESENT INVENTION

The main objective of the present invention is to provide metal nanosponges/nano structures.

Another objective of the present invention is to develop a template free, single step process for the preparation of metal nanosponges.

Yet another objective of the present invention is to provide metal nanosponges which are having high surface area, low density and porous metal nanosponges.

Still another objective of the present invention is to provide template free and polymer free metal nanosponges which can be used in surface enhanced Raman Spectroscopy [SERS] and also for their anti-bacterial activity.

STATEMENT OF THE INVENTION

Accordingly, the present invention provides a template free and polymer free metal nanosponges; a process for preparation of template free metal nanosponge, said process comprising steps of: mixing equimolar concentration of one part of metal precursor and five parts of reducing agent solution to obtain a spongy solid; and filtering and washing the spongy solid followed by drying to obtain the metal nanosponge; and use of template free and polymer free metal nanosponge as substrates for surface-enhanced Raman Spectroscopy and for anti-bacterial activity.

BRIEF DESCRIPTION OF THE ACCOMPANYING DRAWINGS

FIG. 1 Schematic of silver sponge formation process

Figure 2:
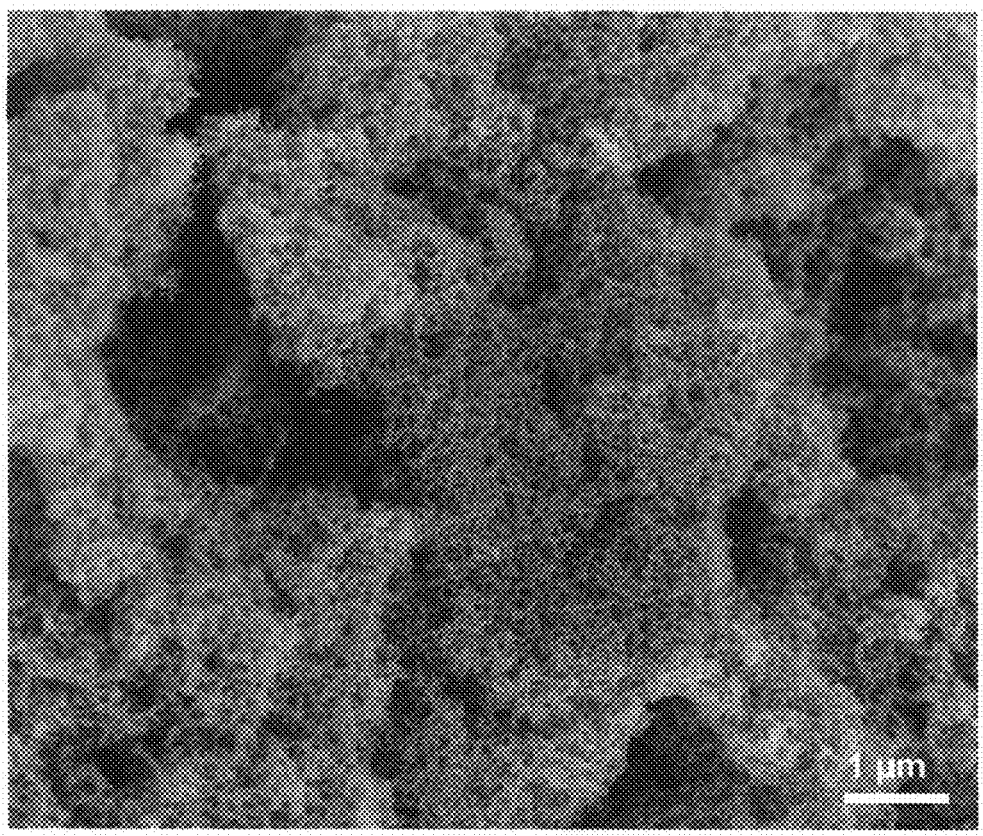
Figure 3:
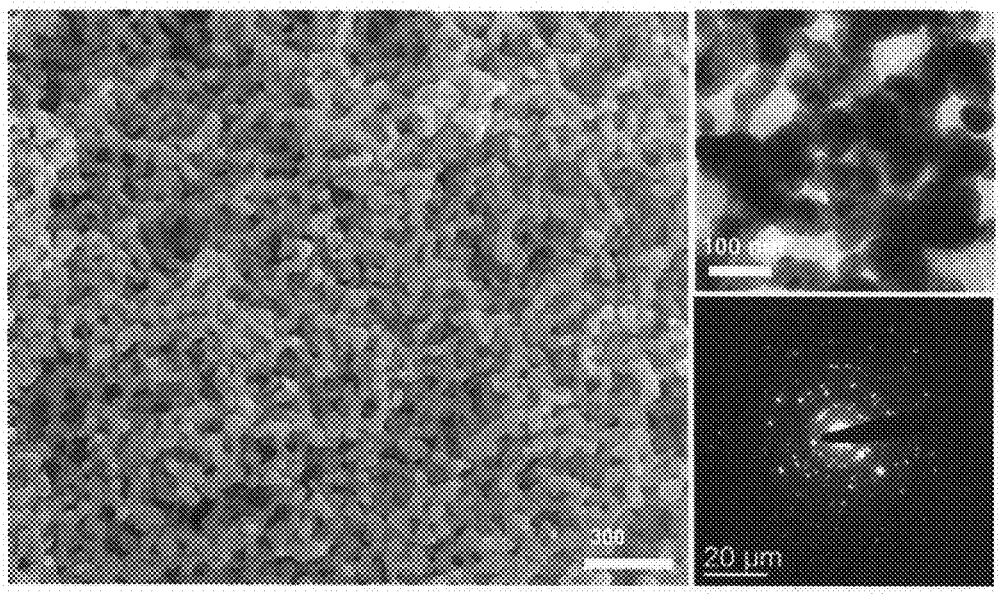

FIG. 2 Low-magnification FESEM image of silver sponge

FIG. 3

Figure 4:
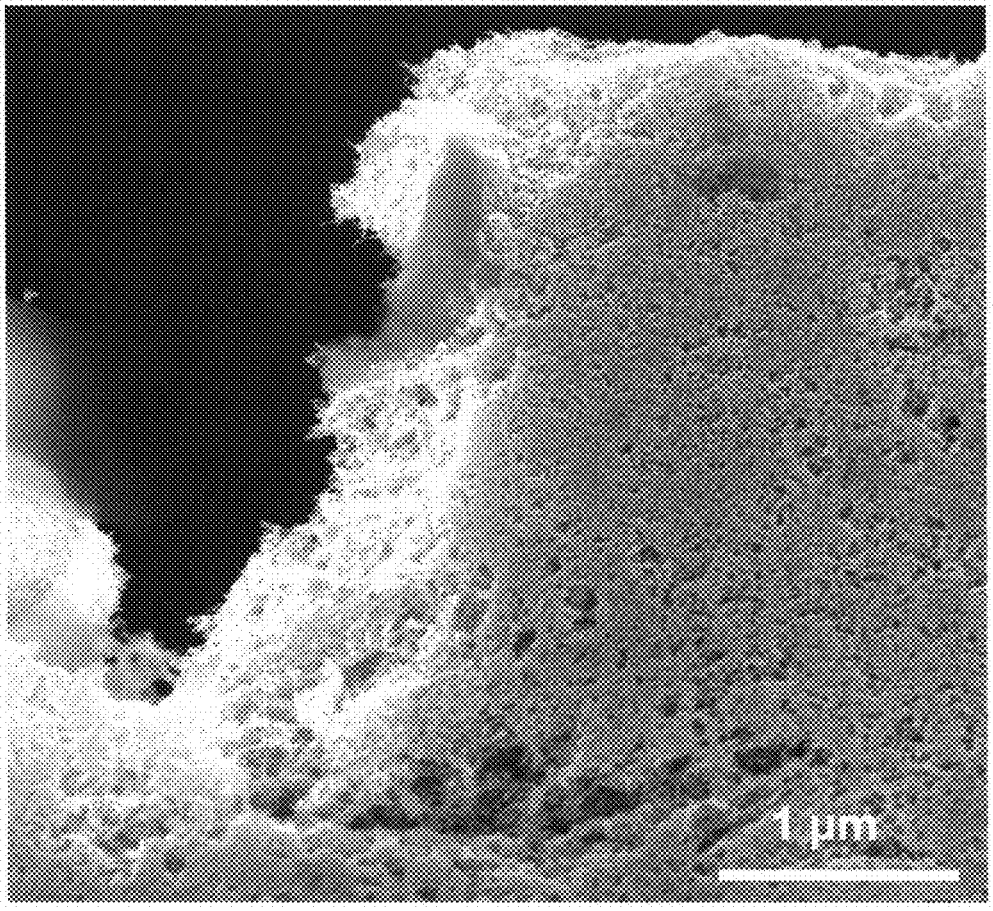
Figure 5:
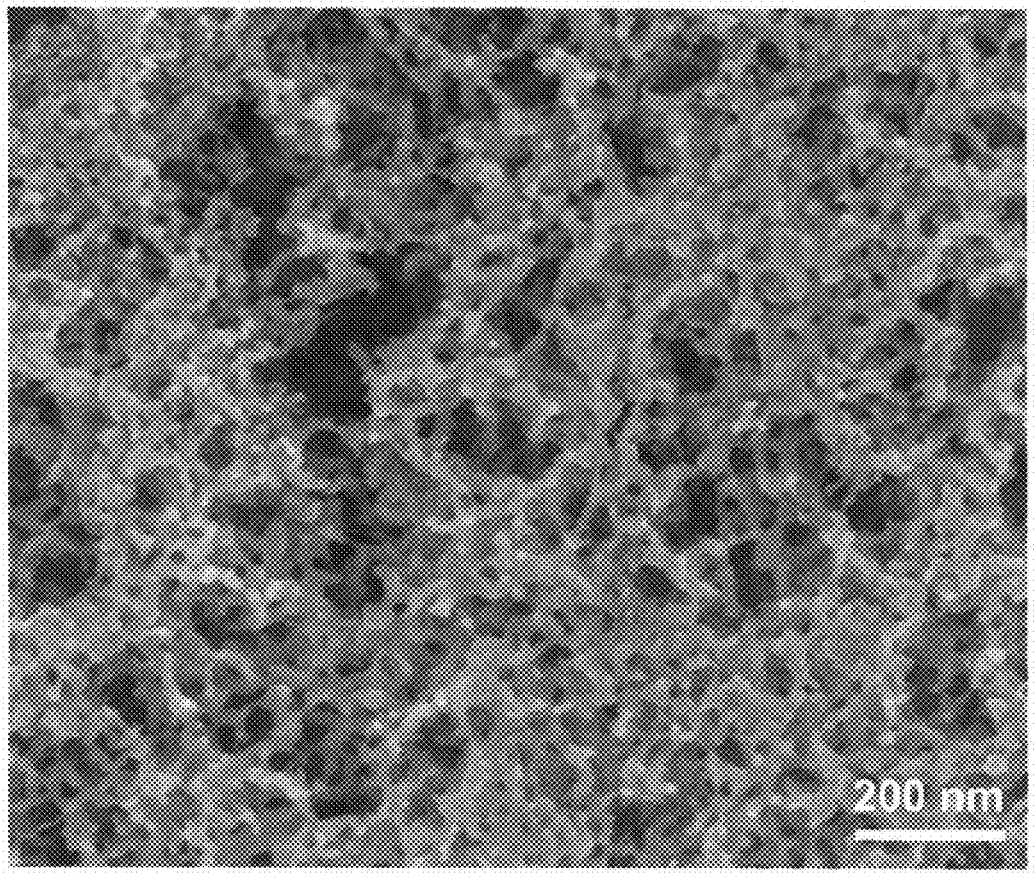
Figure 6:
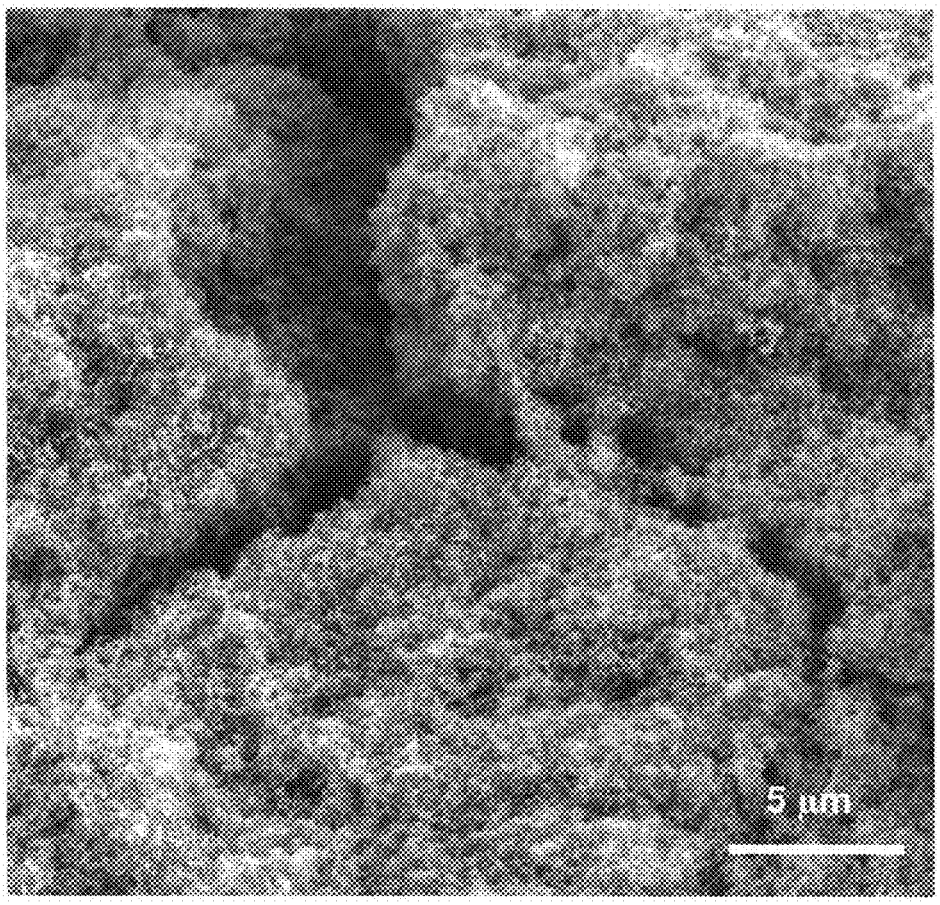
Figure 7:
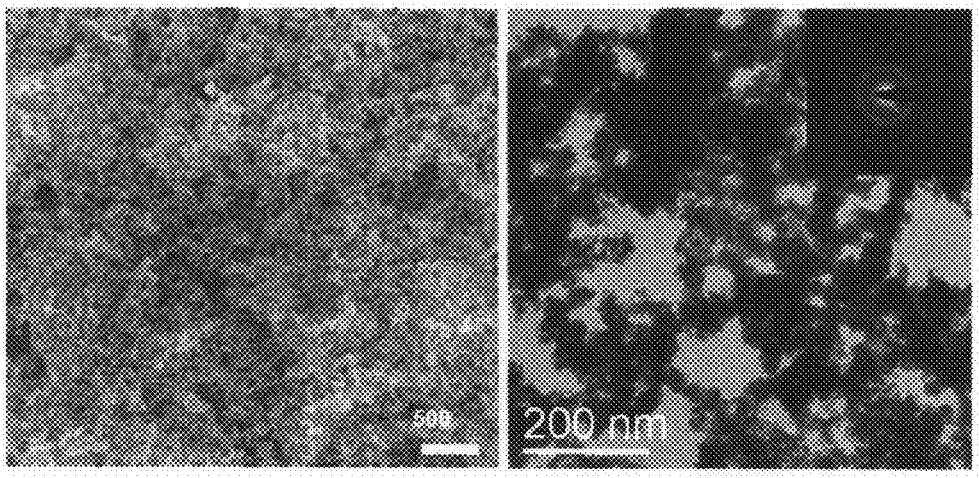

(a) High-magnification FESEM image of silver sponge (b) TEM image showing Interconnected silver ligaments of size 30-50 nm (c) Electron Diffraction pattern showing its polycrystalline nature FIG. 4 Low-magnification FESEM image of gold sponge FIG. 5 High-magnification FESEM image of gold sponge FIG. 6 Low-magnification FESEM image of platinum sponge

FIG. 7

Figure 8:
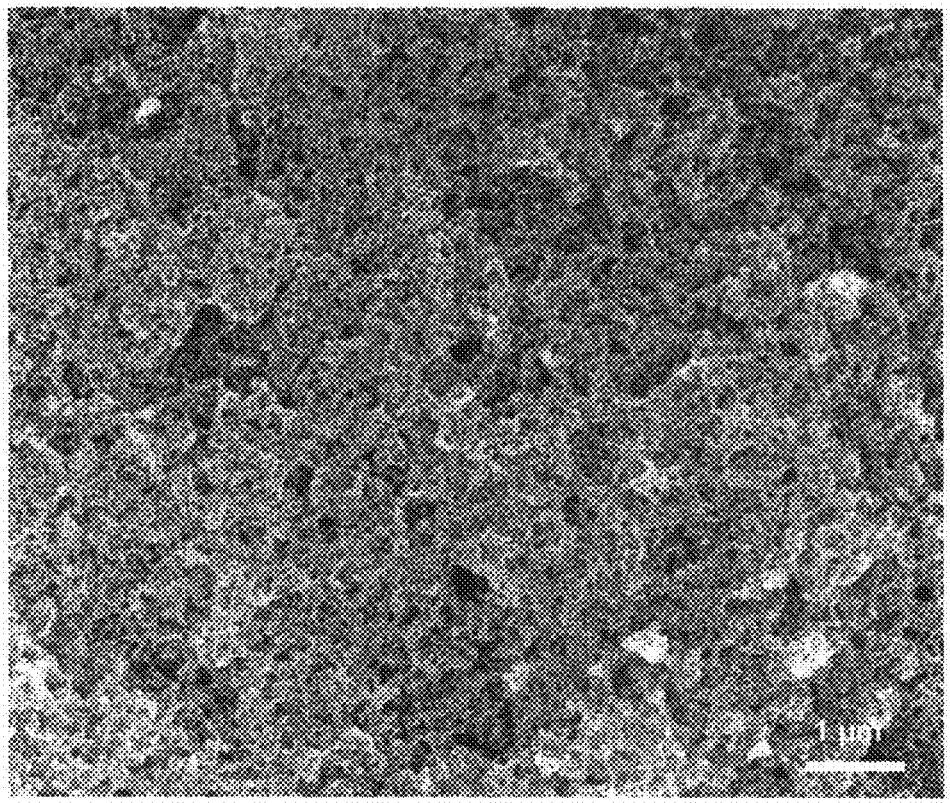
Figure 9:
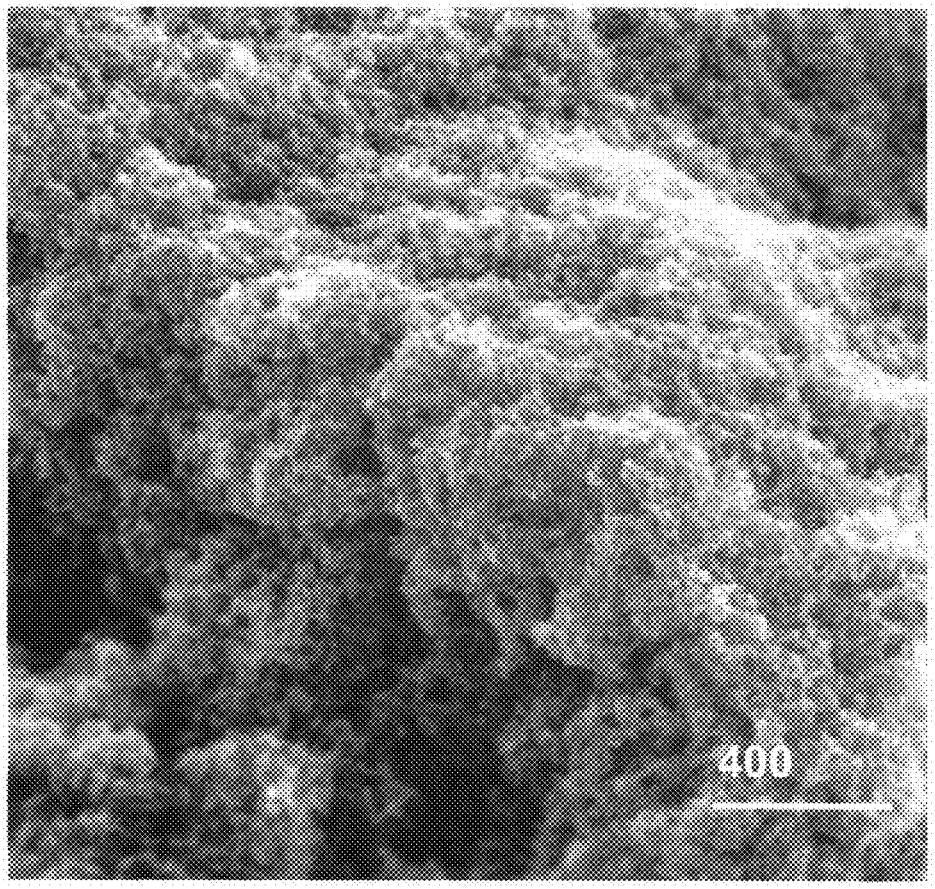
Figure 10:
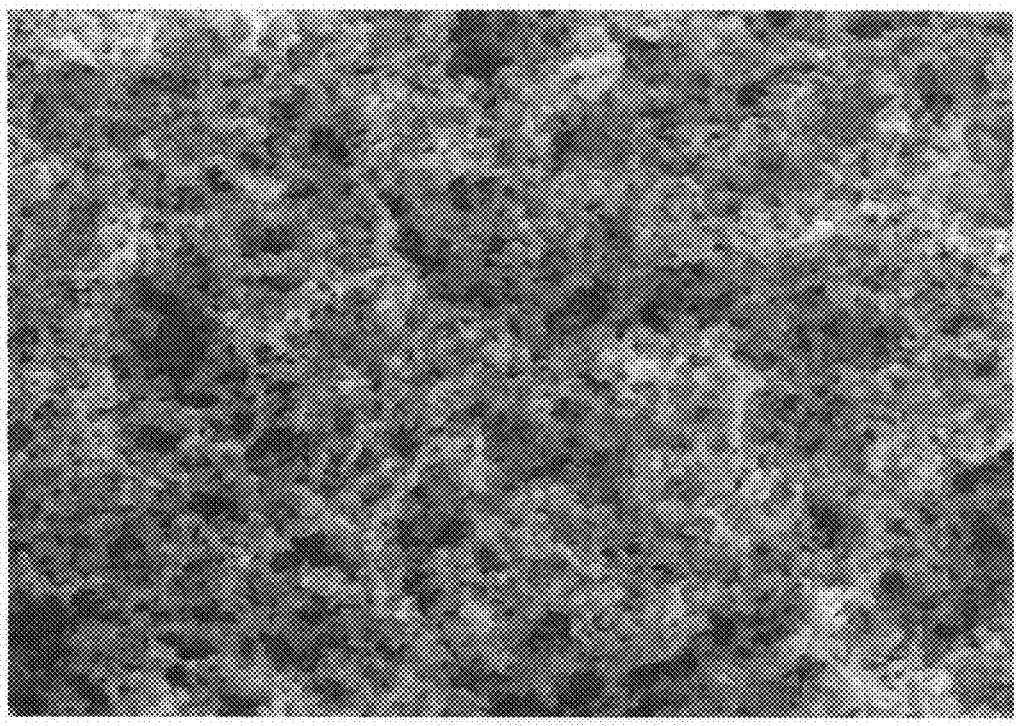
Figure 11:
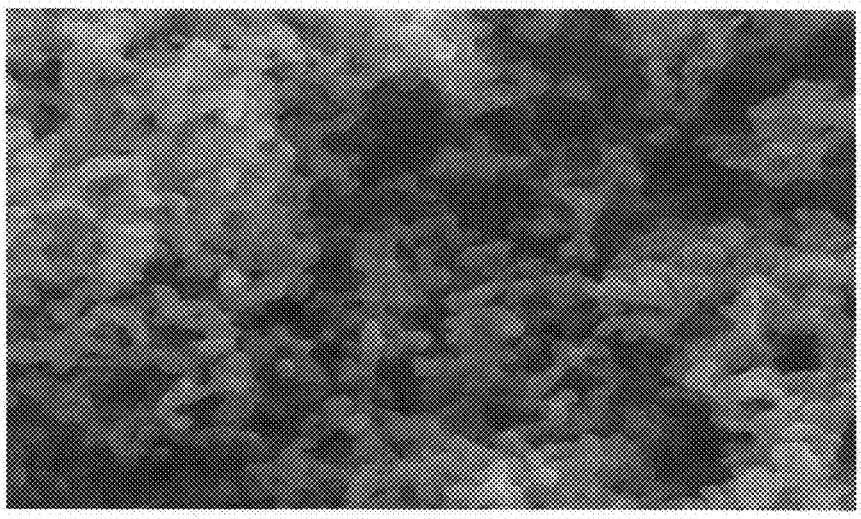
Figure 12:
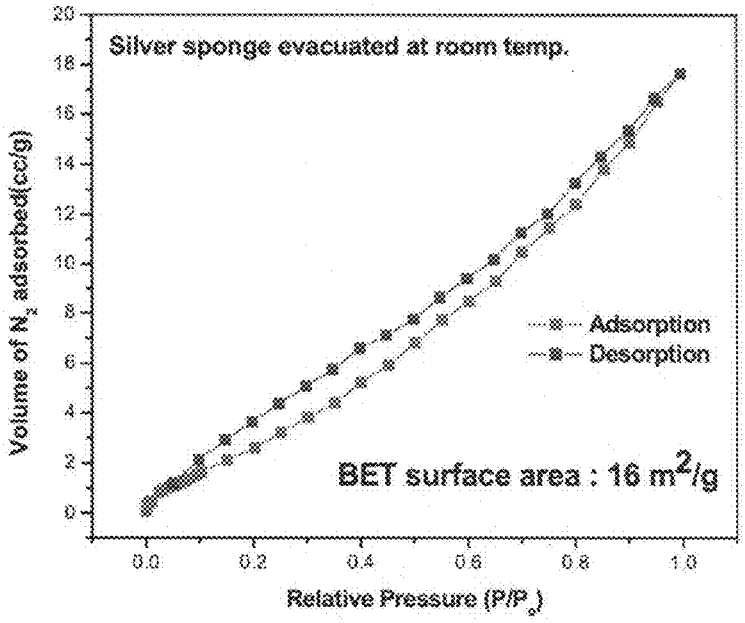
Figure 13:
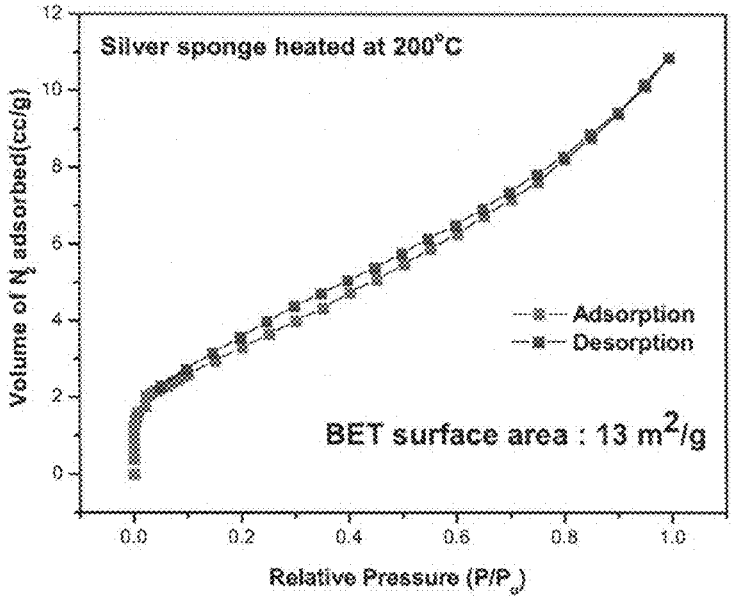

(a) Low-magnification FESEM image of platinum sponge (b) TEM image of platinum sponge. Inset showing the ED pattern for polycrystalline nature of platinum FIG. 8 Low-magnification FESEM image of palladium sponge FIG. 9 High-magnification FESEM image of palladium sponge FIG. 10 Low-magnification FESEM image of copper/copper oxide sponge FIG. 11 High-magnification FESEM image of copper/copper oxide sponge FIG. 12 Nitrogen adsorption/desorption isotherms (at −195° C.) of silver sponge evacuated at room temperature FIG. 13 Nitrogen adsorption/desorption isotherms (at −195° C.) of silver sponge heated at 200° C.

Figure 14:
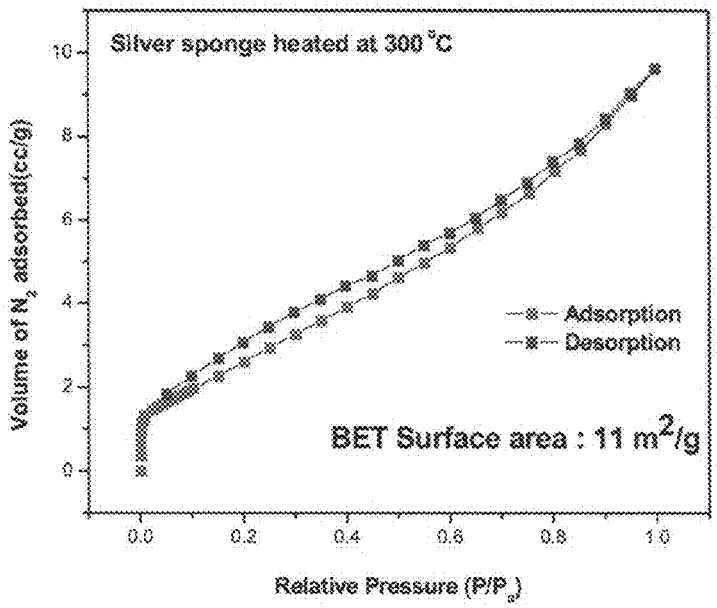

FIG. 14 Nitrogen adsorption/desorption isotherms (at −195° C.) of silver sponge heated at 300° C.

Figure 15:
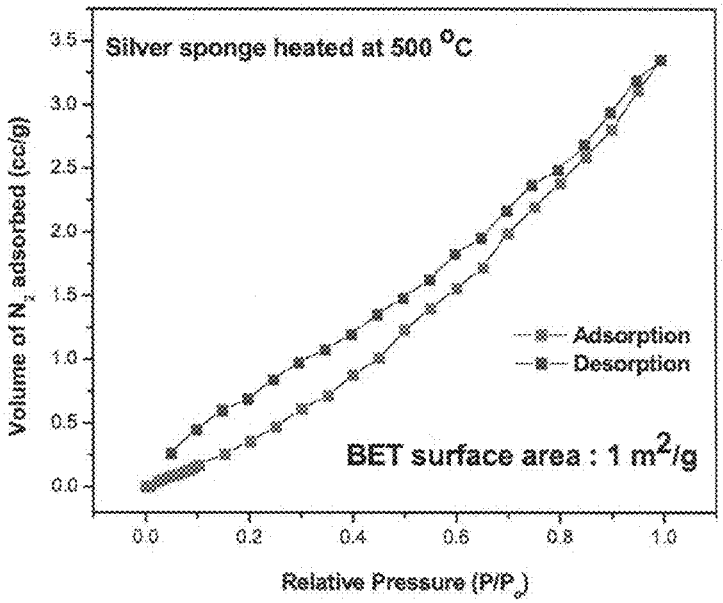

FIG. 15 Nitrogen adsorption/desorption isotherms (at −195° C.) of silver sponge heated at 500° C.

Figure 16:
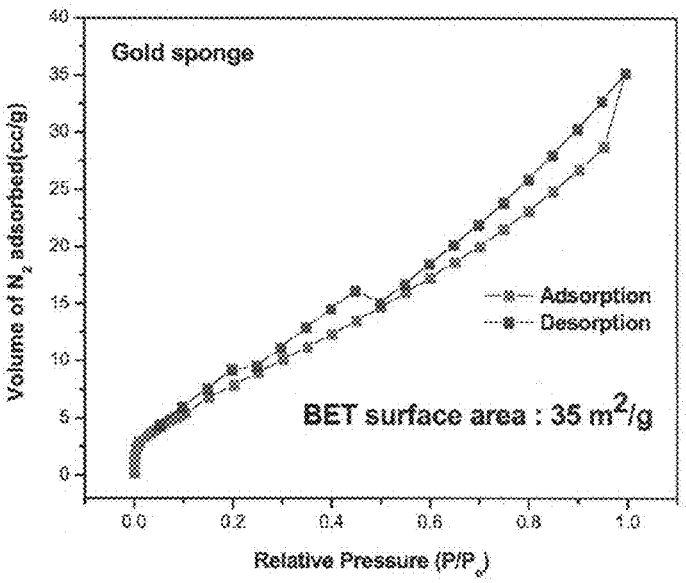
Figure 17:
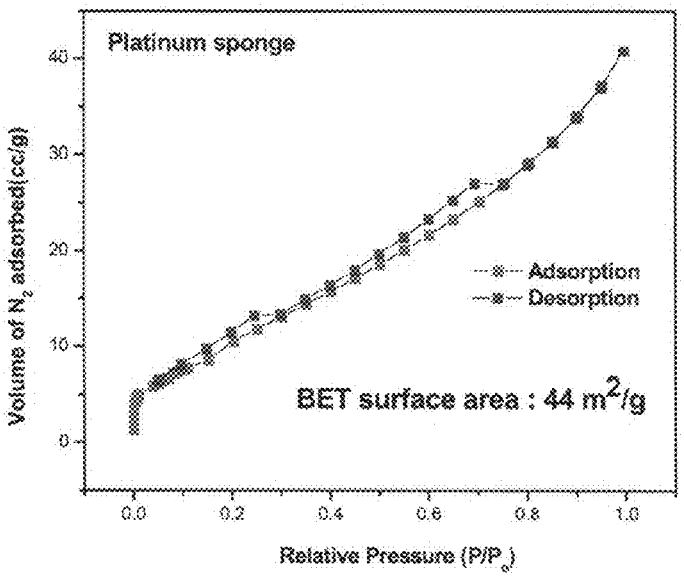
Figure 18:
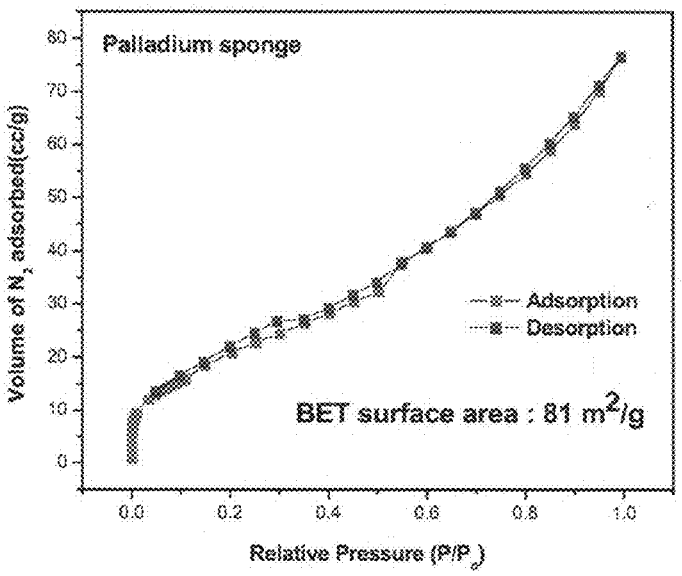
Figure 19:
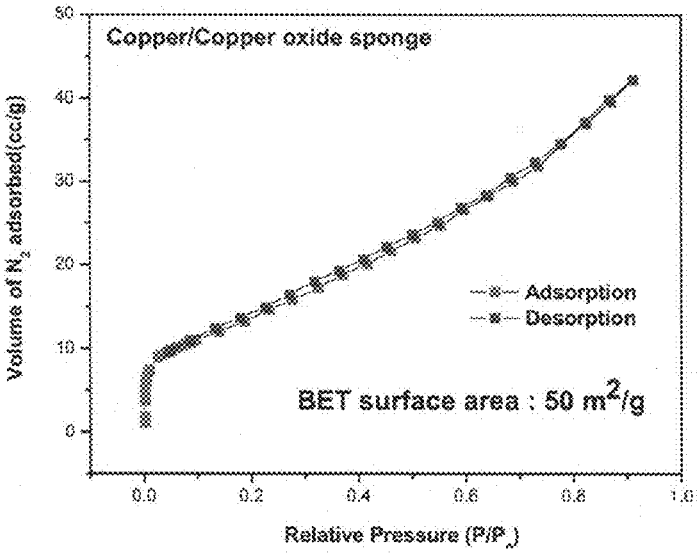
Figure 20:
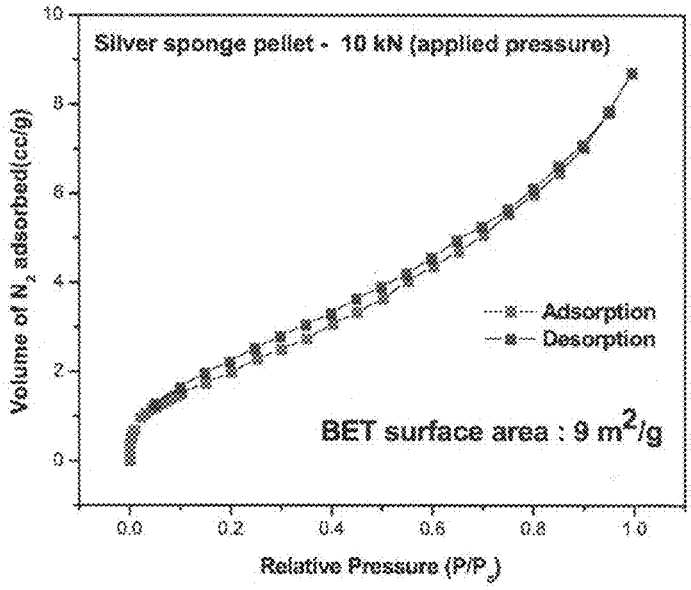
Figure 21:
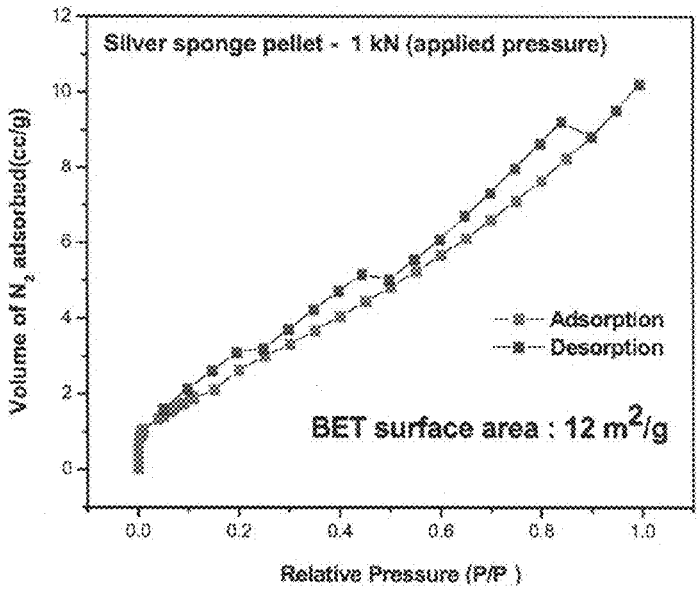
Figure 22:
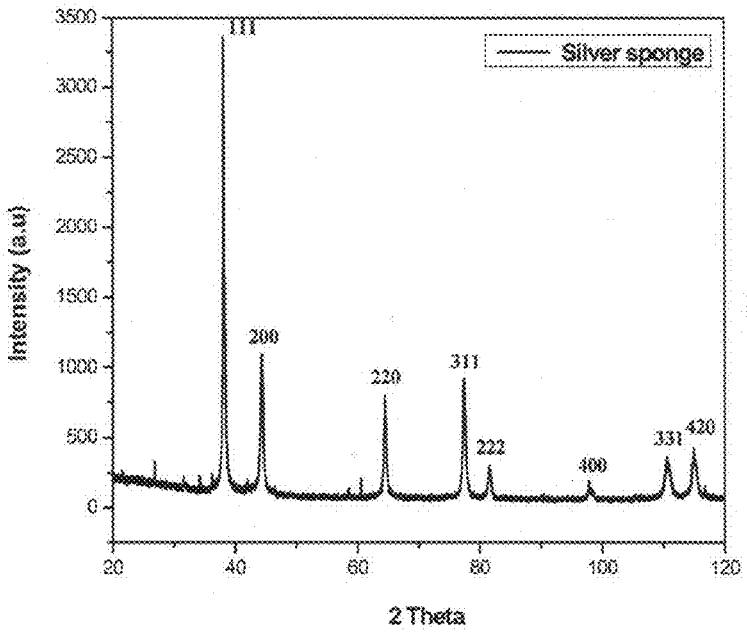
Figure 23:
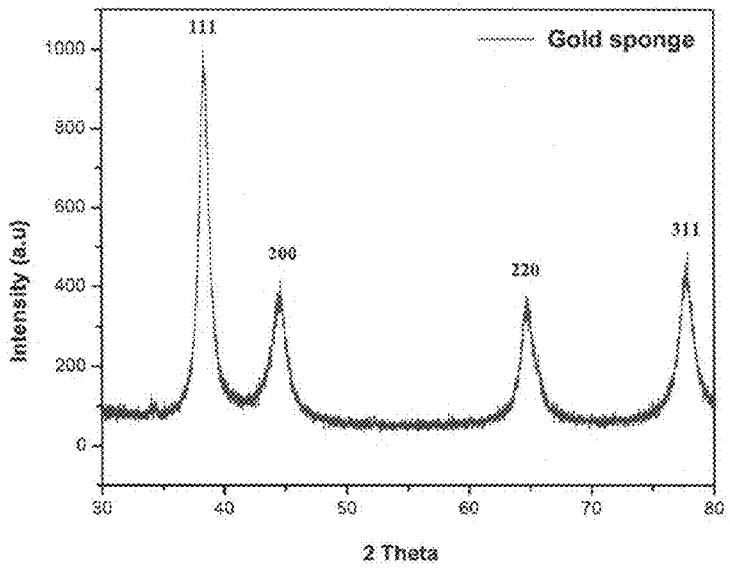
Figure 24:
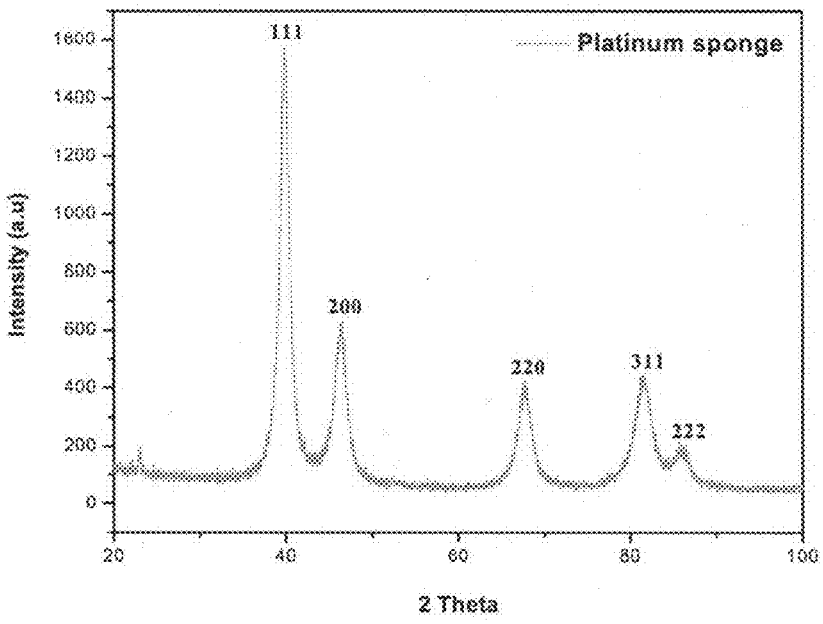
Figure 25:
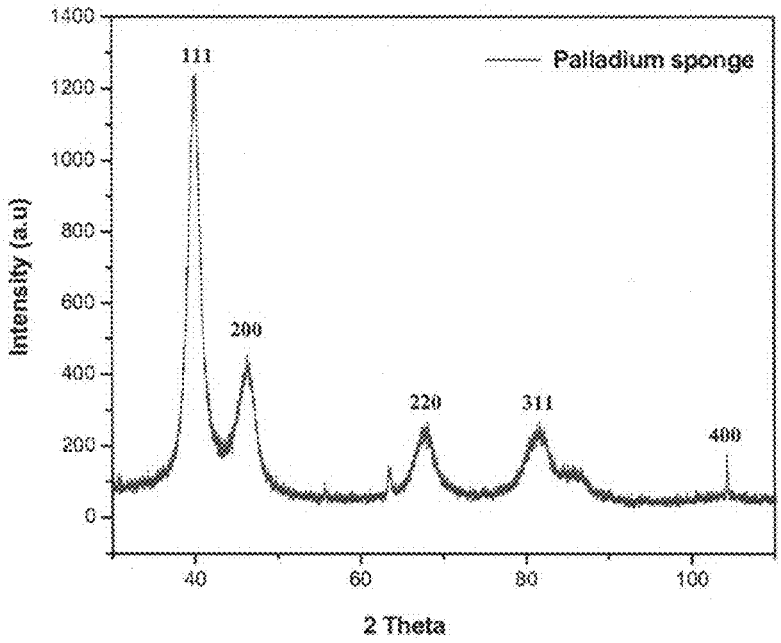
Figure 26:
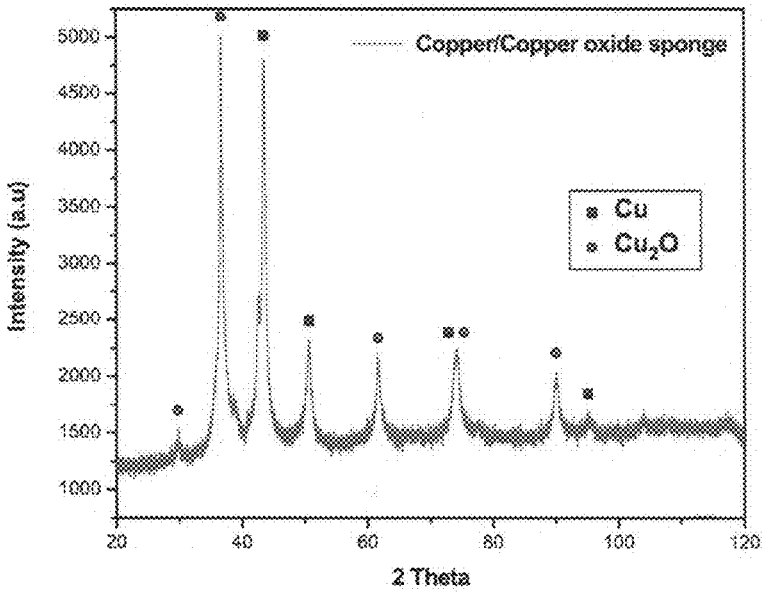

FIG. 16 Nitrogen adsorption/desorption isotherms (at −195° C.) of gold sponge FIG. 17 Nitrogen adsorption/desorption isotherms (at −195° C.) of platinum sponge FIG. 18 Nitrogen adsorption/desorption isotherms (at −195° C.) of palladium sponge FIG. 19 Nitrogen adsorption/desorption isotherms (at −195° C.) of copper/copper oxide sponge FIG. 20 Nitrogen adsorption/desorption isotherms (at −195° C.) of silver sponge pellet pressed at 10 kN FIG. 21 Nitrogen adsorption/desorption isotherms (at −195° C.) of silver sponge pellet pressed at 1 kN FIG. 22 X-ray diffraction pattern of silver sponge FIG. 23 X-ray diffraction pattern of gold sponge FIG. 24 X-ray diffraction pattern of platinum sponge FIG. 25 X-ray diffraction pattern of palladium sponge FIG. 26 X-ray diffraction pattern of copper/copper oxide sponge

FIG. 27

Figure 28:
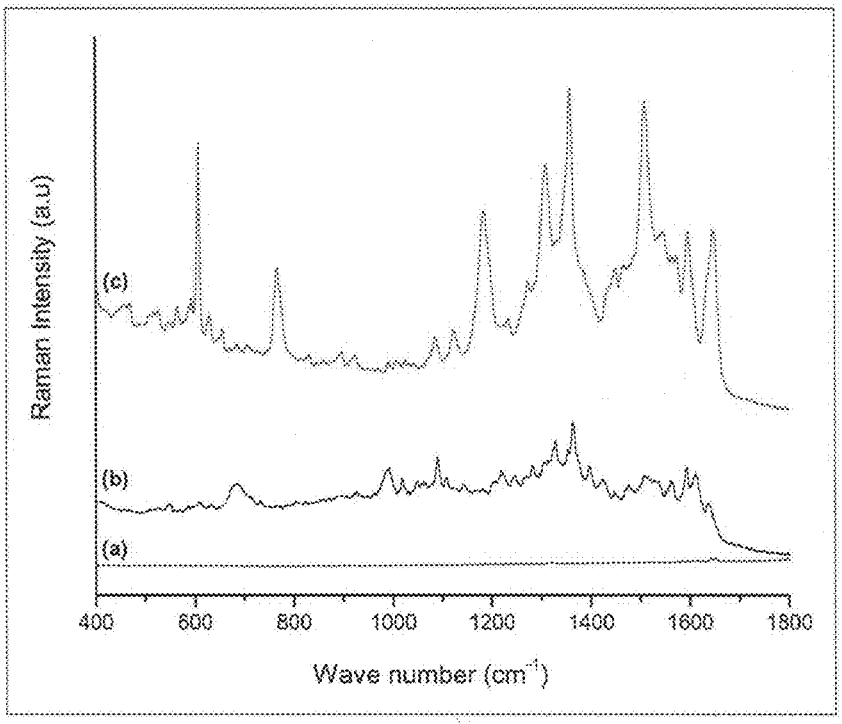

(a) Photograph showing pellets of silver sponge pressed at 10 kN and 1 kN pressures respectively (b) Cross sectional view of a silver sponge pellet pressed at 1 kN FIG. 28 Surface-enhanced Raman spectra (SERS) of (a) Rhodamine 6G ($10^{-4}$ M)

Figure 29:
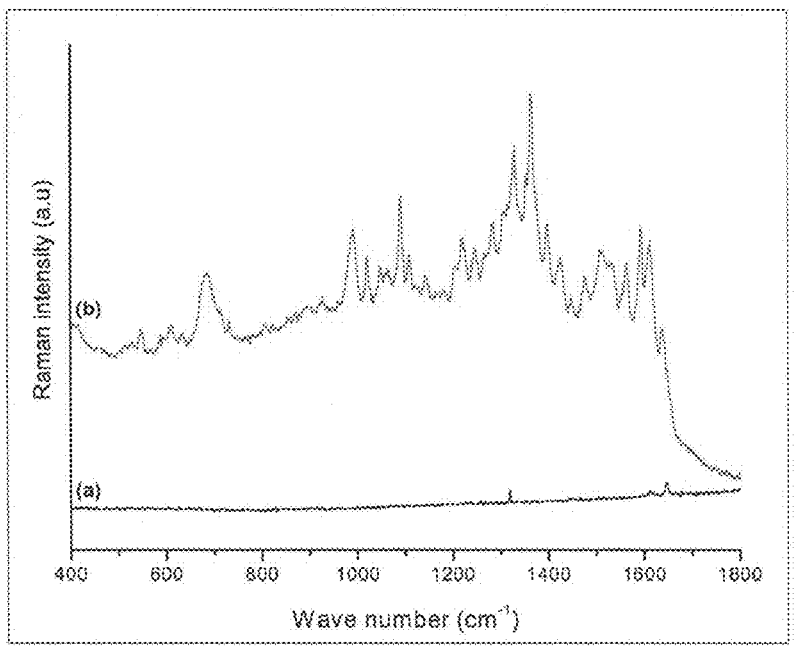

(b) Rhodamine 6G ($10^{-6}$ M) on silver nanosponge (c) Rhodamine 6G ($10^{-4}$ M) on silver nanosponge FIG. 29 Surface-enhanced Raman spectra (SERS) of (a) Rhodamine 6G ($10^{-6}$ M) on gold nanosponge and (b) Rhodamine 6G ($10^{-4}$ M)

Figure 30:
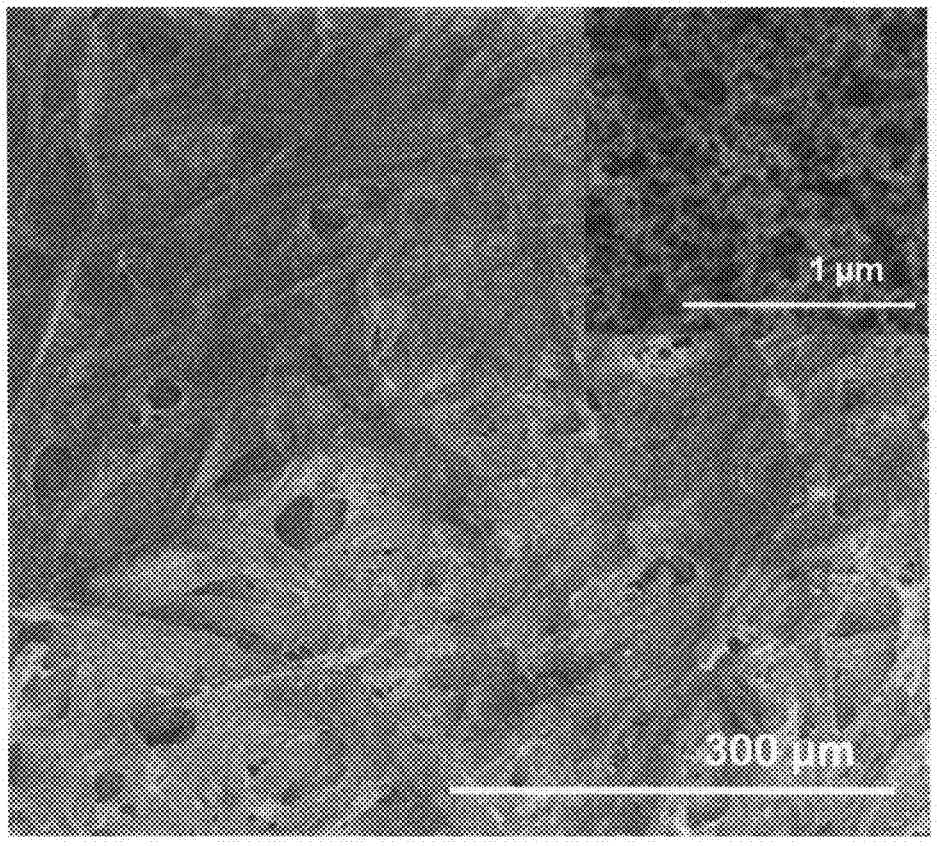

FIG. 30 FESEM image of the silver nanosponge—Whatmann filter paper composite. Inset shows the high magnification image of the silver nanosponge deposited on the paper.

FIG. 31 Photographs showing (a) Whatman filter membrane (b) Whatman filter membrane embedded with silver nanosponge (c) Anti-bacterial activity of the silver nanosponge—Whatman filter membrane composite against *E. coli* bacteria.

DETAILED DESCRIPTION OF THE PRESENT INVENTION

The present invention is in relation to a template free and polymer free metal nanosponge.

In another embodiment of the present invention said metal is selected from a group comprising gold, silver, platinum, palladium, and copper.

In yet another embodiment of the present invention said metal nanosponge is porous, stable, black in colour, has low density and high surface area.

In still another embodiment of the present invention porosity is ranging from about 50 nm to about 100 nm, density is ranging from about 0.5 $gcm^{-3}$ to about 1 $gcm^{-3}$ and stable at temperature ranging from about 25° C. to about 300° C.

In still another embodiment of the present invention the surface area of silver nanosponge is ranging from about 13 $m^2/g$ to about 18 $m^2/g$, preferably about 16 $m^2/g$, gold nanosponge is ranging from about 41 $m^2/g$ to about 45 $m^2/g$, preferably about 43 $m^2/g$, platinum nanosponge is ranging from about 40 $m^2/g$ to about 46 $m^2/g$, preferably about 44 $m^2/g$ palladium nanosponge is ranging from about 78 $m^2/g$ to about 84 $m^2/g$, preferably about 81 $m^2/g$ and copper nanosponges is ranging from about 48 $m^2/g$ to about 53 $m^2/g$, preferably about 50 $m^2/g$.

The present invention is in relation to a process for preparation of template free and polymer free metal nanosponge, said process comprising steps of: mixing equimolar concentration of one part of metal precursor and five parts of reducing agent solution to obtain a spongy solid; and filtering and washing the spongy solid followed by drying to obtain the metal nanosponge.

In another embodiment of the present invention said metal precursor is selected from a group comprising silver nitrate, chloroauric acid, dihydrogen hexachloroplatinate, palladium dichloride and cuprous nitrate.

In another embodiment of the present invention said equimolar concentration is about 0.1 M.

In yet another embodiment of the present invention said metal precursor and reducing agent are mixed at a volume ratio of about 1:5.

In still another embodiment of the present invention said reducing agent is sodium borohydride.

In still another embodiment of the present invention said mixing of metal precursor solution with reducing agent results in spontaneous formation of effervescence and nano sized ligament metallic networks which aggregate to form a black spongy solid floating on the reaction medium.

In still another embodiment of the present invention said processing step of obtaining a spongy solid floating on reaction medium is completed within a time period of about 5 minutes.

The present invention is in relation to use of template free and polymer free metal nanosponge as substrates for surface-enhanced Raman Spectroscopy and for anti-bacterial activity.

The technology of the instant Application is further elaborated with the help of following examples. However, the examples should not be construed to limit the scope of the invention.

Example: 1

Experimental Procedure

Porous silver sponge has been synthesized by adding 10 ml aqueous solution of 0.1 M $AgNO_3$ to 50 ml aqueous solution of 0.1 M $NaBH_4$ ($NaBH_4/AgNO_3$ solution volume ratio=5). Addition of silver nitrate to the borohydride solution resulted in the spontaneous formation of effervescence (due to the release of hydrogen) with a black spongy solid floating on the reaction medium. The floating solid was filtered and washed with distilled water and later dried at room temperature. The whole reaction can be completed within 5 minutes. To verify the optimum amount of $NaBH_4$ required, experiments were carried out at different volume ratios (1, 2, 3 and 4) of $NaBH_4/AgNO_3$ of 0.1 M concentrations. Similarly, the same synthesis procedure is followed at different concentrations of $AgNO_3$ (1 mM and 2 M respectively) keeping the $NaBH_4$ concentration constant, 0.1 M. FIG. 1 provides for the schematic representation for the formation of silver metal nanosponges.

In a similar method gold nanosponge was synthesized by adding 10 ml of 0.1 M $HAuCl_4$ to 50 ml of 0.1 M $NaBH_4$ Platinum and palladium nanosponges were synthesized by adding 10 ml of 0.1 M metal precursors ($H_2PtCl_6$ for platinum and $PdCl_2$ for palladium) to 50 ml of 0.1 M $NaBH_4$. It is also possible to form porous sponges of these noble metals with different concentrations. $Cu/Cu_2O$ nanosponge was prepared by the addition of 10 ml of 0.1 M copper nitrate solution to 50 ml of 0.1 M $NaBH_4$ solution.

Discussion:

Porous silver sponge with high surface area can be readily formed merely by mixing a solution of silver nitrate with borohydride of optimum concentration. If the concentration of silver nitrate is low, around 1.0 mM, porous silver network does not form, no matter how much amount of 0.1 M sodium borohydride is added. If the concentration of silver nitrate is 0.1 M, addition of equal volume of sodium bororohydride (of 0.1 M concentration) resulted in a micron sized ligment silver networks. However, increasing the concentration of borohydride (to 0.2 M) or double the volume of 0.1 M sodium borohydride gives a very porous network made up of nano-sized ligaments (30 to 50 nm).

The formation of silver nanosponge is favourable when the concentration of silver nitrate and sodium borohydride solution are kept 0.1 M and above.

The silver nanosponge prepared with a volume ratio of 1:5 (for 0.1 M $AgNO_3$ solution: 0.1 M $NaBH_4$ solution) has a surface area of 16 $m^2/g$ which is the highest surface area for a silver sponge (prepared with out any template) reported so far. It is clear from our studies that to form the metal nanosponge, we need to have some critical amount of metal ions in solution. If the concentration of metal ions is below the critical level, it favours the formation of colloidal nanoparticles stabilized in solution. For example, 1.0 mM colourless silver nitrate solution gives yellow to dark green colour solution on reduction with sodium borohydride (1 mM or 0.1 M concentration) due to the dispersion of silver nanoparticles stabilized by the excess borohydride anions on its surface. The table 1 below provides list of metal nanosponges and their surface area. Also, table 2 provides comparison of metal nanosponges prepared using 0.1M and 2 M solutions of metal precursors and reducing agent.

TABLE 1

List of metal nanosponges and their respective surface area

| Material | BET Surface Area (m2/g) |
|---|---|
| Silver sponge | 16 |
| Gold sponge | 35 |
| Platinum sponge | 44 |
| Palladium sponge | 81 |
| Copper/Copper oxide sponge | 50 |
| Silver sponge pellet @ 10 kN (applied pressure) | 9 |
| Silver sponge pellet @ 1 kN (applied pressure) | 12 |
| Silver sponge heated at 200° C. for 5 h | 13 |
| Silver sponge heated at 300° C. for 5 h | 11 |
| Silver sponge heated at 500° C. for 5 h | 1 |

TABLE 2

Comparison between 0.1M and 2M metal nanosponges

| Material | BET Surface Area (m2/g) Of 0.1M samples | BET Surface Area (m2/g) Of 2M samples |
|---|---|---|
| Silver sponge | 16 | 14 |
| Gold sponge | 41 | 13 |
| Platinum sponge | 44 | 48 |
| Palladium sponge | 81 | 58 |

Addition of sodium borohydride to the silver nitrate solution creates lots of silver nuclei (clusters) which act as the nucleation centers for further growth. The number of the nucleation sites (reduced silver sites) formed is directly proportional to the amount of borohydride added. With time, Oswald ripening occurs fusing the small nanoparticles to form chained interconnected networks of silver (if the concentration of silver nitrate is around 0.1 M and above). These networks aggregate to form a black spongy solid that floats in the solution. The size of the ligaments in the nanosponge can be tuned by changing the concentration of sodium borohydride. The FESEM images of various metal nanosponges are provided in FIGS. 2 to 11.

Example: 2

Stability Studies

To study the stability of the silver sponge at higher temperatures, we have heated the as formed sponge at different temperatures and measured the surface areas of those samples. The sample treated at 200° C. has a surface area of 13 $m^2/g$ and sample treated at 300° C. has a surface area of 11 $m^2/g$ and a sample treated at 500° C. has a surface area of 1 $m^2/g$. As the temperature increases, the surface area of the silver sponge decreases. This can be attributed to the fact that as the temperature increases, nanoparticles sinter to form bigger particles which further decreases the surface area. The experimental results obtained in the study of nitrogen adsorption/desorption isotherms of various metal nanosponges are provided in FIGS. 12 to 21. Similarly, the X-ray diffraction studies for various metal nanosponges are provided in FIGS. 22 to 26.

Figure 27:
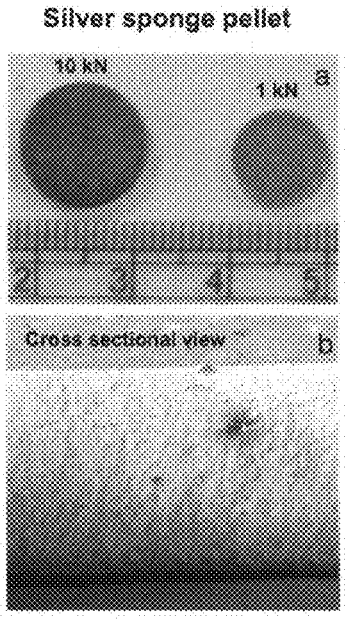

This porous silver sponge can also be pressed in the form of a pellet to obtain a monolith without altering much of its surface area. Pellets were made by applying two different pressures, 1 kN and 10 kN and their surface areas were also measured. A pellet made of 1 kN pressure has a surface area of 12 $m^2/g$ and for a pellet made of 10 kN, has a surface area of 9 $m^2/g$. Pellets can be formed of different sizes and shapes by applying various pressures. The surface area slightly decreases as the applied pressure increases. The decrease in surface area here is due to the reduction of void size as well as the fusion of smaller silver nano ligaments into larger ones. A photograph showing pellets of silver sponge pressed at 10 kN and 1 kN respectively and cross sectional view of a silver sponge pellet pressed at 1 kN are showed in FIG. 27.

The similar procedure applied to obtain porous sponges of other noble metals like gold, platinum and palladium too. Each of these metal sponges prepared were having a high surface area for the unsupported metals reported so far. In all these synthesis procedures, the concentration of the metal precursor and sodium borohydride was maintained at 0.1 M and also the volume ratio of the metal salt and the borohydride solution has been maintained at 1:5 throughout. Irrespective of the metal present, all the metal sponges obtained were black in color with a very low density. The respective surface areas for these metal sponges are, porous gold is 35 $m^2/g$, porous platinum is 44 $m^2/g$ and porous palladium is 81 $m^2/g$. The procedure followed here in to obtain porous metal sponges is the simplest procedure ever reported and also an inexpensive, single step room temperature synthesis which can be scalable to desired amount.

Example: 3

Applications of Metal Nanosponges

These metal nanosponges were tested for possible applications. The silver and gold nanosponges were found to be good self-supported substrates for surface-enhanced Raman spectroscopy (SERS) and also the silver nanosponge incorporated Whatman filter membrane has shown significant antibacterial activity.

Surface-Enhanced Raman Spectroscopy (SERS)

The as prepared nanosponges of silver and gold nanosponges were tested for SERS activity. For this purpose, 20 μl of Rhodamine 6G (both $10^{-4}$ M and $10^{-6}$ M) was drop casted onto a glass slide containing 10 mg of the nanosponge sample (in the form of powder or as a pellet). Raman spectra were recorded at room temperature using 632 nm HeNe laser as a source. The characteristic signals for Rhodamine 6G was enhanced multifold when observed over the Ag and Au substrates whereas the Rhodamine 6G dye of $10^{-4}$ M concentration over the glass slide without the nanosponge could not be detected (see FIGS. 28 and 29).

Anti-Bacterial Studies

To study the anti-bacterial activity of the silver, a silver nanosponge—Whatman composite membrane was prepared by dipping a Whatman filter paper (125 mm Ashless circles obtained from Whatman Schleicher & Schuell) in 10 ml of 0.1 M $AgNO_3$ solution for 30 minutes and followed by dipping it in a 50 ml 0.1 M $NaBH_4$ solution. Immediate reaction resulted in a dark grey colored membrane. The membrane was washed several times with Millipore water and dried at room temperature prior to the study of anti-bacterial activity.

Anti-bacterial study was done using *E. Coli* (DH5α). The bacteria were inoculated in LB (Luria Bertani) broth and grown overnight at 37° C. in a shaker incubator. The bacterial cells were spread plated on an agar medium (1.5% agar plates were made for the purpose). The composite membrane were placed on these plates and incubated overnight at 37° C. The bacterial growth was observed over the entire plates except for the zone where the composite membranes were placed. An inhibition zone was clearly seen surrounding the region of the membranes (see FIGS. 30 and 31).

REFERENCES

1. Walsh D, Arcelli L, Ikoma T, Tanaka J and Mann S 2003 *Nature Mater.* 2 385
2. Khan F, Eswaramoorthy M and Rao C N R 2007 *Solid State Sciences* 9 27
3. He J, Kunitake T and Watanabe T 2005 *Chem. Commun.* 795
4. Jin R-H and Yuan J-J 2005 *J. Mater. Chem.* 15 4513.
5. Seshadri R and Meldrum F 2000 *Chem. Commun.* 29
6. Kulinowski K M, Jiang P, Vaswani H and Colvin V L 2000 *Adv. Mater.* 12 833
7. Erlebacher J, Aziz M J, Karma A, Dimitrov N and Sieradzki K *Nature* 410 450

We claim:

1. A template free and polymer free metal nanosponge, said metal nanosponge selected from the group consisting of silver, gold, platinum, palladium and copper nanosponge, each having maximum individual surface area of about 16 $m^2/g$, 35 $m^2/g$, 48 $m^2/g$, 81 $m^2/g$ and 50 $m^2/g$, respectively.

2. The nanosponge as claimed in claim 1, wherein said metal nanosponge is black in colour, stable at temperature ranging from about 25° C. to about 300° C., has porosity ranging from about 50 nm to about 100 nm and has density ranging from about 0.5 g $cm^{-3}$ to about 1 g $cm^{-3}$.

3. A process for preparation of template free and polymer free metal nanosponge, said process comprising:

mixing equimolar aqueous solutions of metal precursor and of reducing agent in a volume ratio of one of metal precursor to five of the reducing agent to form a spongy solid of template free and polymer free metal nanosponge, wherein the reducing agent is sodium borohydride, and wherein the equimolar aqueous solutions range from about 0.1 M to about 2 M.

4. The process as claimed in claim 3, wherein the template free and polymer free metal nanosponge is selected from the group consisting of gold, silver, platinum, palladium and copper nanosponge, each having maximum individual surface area of about 16 $m^2/g$, 35 $m^2/g$, 48 $m^2/g$, 81 $m^2/g$ and 50 $m^2/g$, respectively.

5. The process as claimed in claim 3, wherein said metal precursor is selected from the group consisting of chloroauric acid, silver nitrate, dihydrogen hexachloroplatinate, palladium dichloride and cuprous nitrate.

6. The process as claimed in claim 3, further comprising filtering and washing the spongy solid followed by drying to obtain the template free and polymer free metal nanosponge.

7. The process as claimed in claim 3, wherein said mixing of metal precursor solution with reducing agent results in spontaneous formation of effervescence and nano sized ligament metallic networks which aggregate to form a black spongy solid floating on the reaction medium.

8. The process as claimed in claim 7, wherein the process of obtaining a spongy solid floating on reaction medium is completed within a time period of about 5 minutes.

9. A method for performing surface enhanced Raman Spectroscopy (SERS) on a sample using template free and polymer free metal nanosponge as substrate, said method comprising steps of:

a) drop casting the sample onto the nanosponge contained on a glass slide; and b) performing SERS on the sample, wherein the metal nanosponge is made by a process according to claim 3.

10. A method for testing antibacterial activity of metal using template free and polymer free metal nanosponge as substrate, said method comprising steps of:

a) preparing a metal nanosponge-filter paper composite membrane by forming a nanosponge on a filter paper; and b) contacting bacterial cells with the prepared composite membrane for testing the antibacterial activity of the metal, wherein the metal nanosponge is made by a process according to claim 3.

11. The nanosponge as claimed in claim 1, wherein the surface area of a silver nanosponge is 14-16 $m^2/g$, the surface area of a gold nanosponge is 13-35 $m^2/g$, the surface area of a platinum nanosponge is 44-48 $m^2/g$, the surface area of a palladium nanosponge is 58-81 $m^2/g$, and the surface area of a copper nanosponge is 50 $m^2/g$.

12. A silver nanosponge according to claim 11.

13. A gold nanosponge according to claim 11.

14. A platinum nanosponge according to claim 11.

15. A palladium nanosponge according to claim 11.

16. A copper nanosponge according to claim 11.

17. A silver nanosponge made by a process according to claim 3.

18. A gold nanosponge made by a process according to claim 3.

19. A platinum nanosponge made by a process according to claim 3.

20. A palladium nanosponge made by a process according to claim 3.

21. A copper nanosponge made by a process according to claim 3.

22. A silver nanosponge according to claim 17 having a surface area of 14-16 $m^2/g$.

23. A gold nanosponge according to claim 18 having a surface area of 13-35 $m^2/g$.

24. A platinum nanosponge according to claim 19 having a surface area of 44-48 $m^2/g$.

25. A palladium nanosponge according to claim 20 having a surface area of 58-81 $m^2/g$.

26. A copper nanosponge according to claim 21 having a surface area of 50 $m^2/g$.

* * * * *